United States Patent [19]

Nakagawa et al.

[11] Patent Number: 4,728,373

[45] Date of Patent: Mar. 1, 1988

[54] SOLUTION AND PROCESS FOR COLD FORMING TITANIUM

[75] Inventors: Hiroyoshi Nakagawa, Yao; Eiichi Nishi, Monoh; Haruo Kurishima, Suita, all of Japan

[73] Assignee: Nihon Parkerizing Co., Ltd., Tokyo, Japan

[21] Appl. No.: 898,454

[22] Filed: Aug. 20, 1986

[30] Foreign Application Priority Data

Sep. 19, 1985 [JP] Japan ..... 60-205447

[51] Int. Cl.[4] ..... C23C 22/34

[52] U.S. Cl. ..... 148/6.15 R

[58] Field of Search ..... 148/6.14 R, 6.15 L, 148/6.24

[56] References Cited

U.S. PATENT DOCUMENTS

| | | | |
|---|---|---|---|
| 2,728,720 | 12/1955 | De Long | 148/6.14 R |
| 3,041,215 | 6/1962 | Jenkins | 148/6.14 R |
| 4,153,478 | 5/1979 | Parant | 148/6.15 Z |
| 4,419,199 | 12/1983 | Hauffe | 148/6.15 Z |

*Primary Examiner*—Sam Silverberg

*Attorney, Agent, or Firm*—Arthur E. Kluegel

[57] ABSTRACT

An improved solution and process for preparing an article of titanium or titanium alloy for cold forming reduces the peeling of the applied lubricant film. The aqueous solution contains an organic chelating compound, an aqueous organic macromolecular compound and/or a surfactant in an aqueous acidic (pH 1.5–4.5) solution of a fluoride and a soluble compound of magnesium, calcium, manganese, iron, cobalt, nickel, zinc, and/or molybdenum.

4 Claims, No Drawings

SOLUTION AND PROCESS FOR COLD FORMING TITANIUM

BACKGROUND OF THE INVENTION

This invention concerns aqueous chemical treatment solutions for titanium and its alloys in which a film comprising at least one fluoride of magnesium, calcium, manganese, iron, cobalt, nickel, zinc or molybdenum is chemically formed on the surface of the titanium alloy in order to improve the lubrication properties of the surface when the titanium or titanium alloy is being subjected to cold forming.

Fluoride films of titanium borofluoride, titanium silicofluoride etc. were known in the past as lubrication enhancing chemicaally formed films for use in cold forming work with titanium and its alloys.

These films are soft, thin and have poor adhesion properties but these deficiencies can be improved upon by forming metal fluoride films with manganese, molybdenum, magnesium, calcium, iron, cobalt, nickel and zinc in addition to the titanium fluoride.

An example of treatment compositions for the formation of such films is disclosed in Japanese Patent No. 44-28967 (1969). These treatment compositions for titanium and its alloys consist of an aqueous solution of pH 1.5–4.5 which contain 5–40 grams/liter of fluoride ion and 0.1–5 grams/liter of manganese, molybdenum, zinc, magnesium, calcium, iron, cobalt and/or nickel metal ions.

The fluoride ion which is present in the aqueous solution is provided by the addition of hydrofluoric acid, borofluoric acid, silicofluoric acid or their alkali metal or ammonium salts. The metal ions are provided by the addition of the nitrates, sulfates, chlorides, fluorides, oxides, etc. of the metals manganese, molybdenum, zinc, magnesium, calcium, iron, cobalt and nickel.

The acidic aqueous solutions which have a composition of this type are adjusted to pH 1.5–4.5 with ammonium or caustic soda and heated to a temperature within the range 40°–80° C. and then the titanium or titanium alloy material which has been cleaned by degreasing and acid washing in the usual way is dipped into the solution for some 3–15 minutes whereupon the metal fluoride film for use as a lubrication film is chemically formed on its surface.

The aforementioned metal fluoride films can be used in practice as lubrication films for titanium and its alloys but the adhesion with the base material is still unsatisfactory and there is a problem in that peeling and burning occur during cold forming operations.

SUMMARY OF THE INVENTION

The inventors have attempted to overcome this problem by adding additives to an aqueous solution of pH 1.5–4.5 which contains fluoride ion and at least one species of metal ion selected from the group consisting of magnesium, calcium, manganese, iron, cobalt, nickel, zinc and molybdenum. As a result it was found that the aforementioned problem could be overcome by adding at least one chemical selected from the organic chelating compounds, the aqueous organic macromolecular compounds and the surfactants to the aforementioned aqueous solutions.

DETAILED DESCRIPTION OF THE INVENTION

Examples of the organic chelating compounds which can be included in the aforementioned aqueous solutions are gluconic acid, citric acid, tartaric acid, EDTA, NTA, succinic acid, tannic acid and malic acid and their compounds. Of these materials gluconic acid, citric acid, tartaric acid and EDTA are particularly effective and these are added at the rate of 0.1–2 grams/liter. If less than 0.1 gram/liter is added the effect of the addition is inadequate while the addition of more than 2 grams/liter does not provide any additional effect.

Examples of the aqueous organic macromolecular compounds which can be added include polyvinylalcohol, gelatin and polyvinylpyrrolidone and these are added at the rate of 0.1–10 grams/liter. If less than 0.1 gram/liter is added the effect of the addition is inadequate while the addition of more than 10 grams/liter reduces the chemical forming ability of the metal fluoride film.

Surfactants include anionic, cationic, amphoteric and non-ionic based surfactants. Of these materials the use of the non-ionic surfactants is preferred. Examples of surfactants which can be used in the invention include polyoxyethylene esters of oils and fats such as vegetable oils, aliphatic polyethers, sulfates, aliphatic esters, organic polyphosphate esters, amine salts of alkyl aryl phosphates, polyglycol aliphatic esters, alkylphenol polyglycol ethers, modified amines, alkyl aryl sulfonates, amine polyglycol condensates, alkyl aryl polyethers, ethoxylated torr oil, polyoxyethylene ethers and alkylpolyethylene oxide alcohols. Typically the aryl group of these materials is a phenyl group or a naphthyl group and the alkyl groups have from 2 to 20 carbon atoms and in the case of alkoxylated materials the alkylene oxide (such as ethylene oxide or propylene oxide) content is 2–15 mol./molecule.

The amount of surfactant added is within the range 0.01–3 grams/liter and if less than 0.01 gram/liter is added the effect of the addition is inadequate while the addition of more than 3 grams/liter results in large amounts of surfactant being introduced into the water washing tank in the next process and this is undesirable from the pollution point of view and moreover the addition of such large quantities of surfactant does not provide any additional effect.

EXAMPLES 1–5 AND REFERENCE EXAMPLES 1–3

Titanium wire of diameter 3.0 mm and of length 200 mm was subjected to a dipping treatment involving the process sequence: acid washing (nitrofluoric acid)→hot water washing→chemical film forming (68°–72° C., 10 minutes)→water washing→drying and the treated wire was stretched to tensile failure in an "Amusuraa" tensile testing machine.

At this time the adhesion of the film was assessed by the state of retention of the chemically formed film on the neck part where the wire had failed.

The compositions of the aqueous film forming treatmen solutions used in these tests and the results of the film d e ion tests are shown in Table 1.

TABLE 1

| Type of Aqueous Solution | Examples 1 | 2 | 3 | 4 | 5 | Reference Examples 1 | 2 | 3 |
|---|---|---|---|---|---|---|---|---|
| Composition of the Aqueous Solution (grams/liter) pH 2.6 | | | | | | | | |
| NaF.HF | 30 | 30 | 35 | 25 | 35 | 35 | 30 | 25 |
| $Zn^{2+}$ (Zinc nitrate) | 3 | 3 | | | 3 | 3 | | |
| $Mn^{2+}$ (Manganese sulfate) | | | 4 | 3 | | | 3 | 3 |
| $PO_4^{3-}$ (Phosphoric acid) | | 3 | | 2 | | | | 2 |
| EDTA | | | | 0.7 | | | | |
| Citric acid | 0.5 | | | | 0.3 | | | |
| Polyvinyl alcohol | | 0.5 | | 0.5 | 0.8 | | | |
| Surfactant (Polyoxyethylene nonylphenyl ether)* | | 0.05 | 0.2 | | 0.05 | | | |
| Film Weight ($g/m^2$) (5% anhydrous chromic acid, 75° C., 15 minutes) | 4.0 | 5.3 | 5.6 | 5.4 | 4.3 | 4.5 | 4.9 | 5.5 |
| Film adhesion | No. Peeling | No Peeling | No Peeling | No Peeling | No Peeling | Peeling | Peeling | Peeling |

*Polyoxyethylene 7 mole adduct.

As shown by the aforementioned test results, a film which has better adhesion to the surface of titanium and its alloys can be obtained by adding at least one species selected from among the organic chelate compounds, the aqueous organic macromolecular compounds and the surfactants to a conventional aqueous chemical treatment solution for titanium and its alloys which contains fluoride ions and metal ions and so the film does not peel during cold forming operations and burning does not occur.

What is claimed is:

1. A process for cold forming an article of titanium or titanium alloy comprising contacting the surface of the article with an aqueous chemical treatment solution which contains fluoride ion and from 0.1 to 5.0 g/l of at least one type of metal ion selected from the group consisting of magnesium, calcium, manganese, iron, cobalt, nickel, zinc and molybdenum and in which the pH value is 1.5–4.5; said solution additionally comprising at least one chemical selected from among the group consisting of the organic chelating compounds, the aqueous organic macromolecular compounds and the surfactants in an amount sufficient to reduce the peeling of the applied film during cold forming and thereafter subjecting the article to cold deformation.

2. The process of claim 1 wherein the organic chelating compound is present in an amount of 0.1 to 2.0 g/l.

3. The process of claim 1 wherein the aqueous organic macromolecular compound is present in an amount of 0.1 to 10.0 g/l.

4. The process of claim 1 wherein the surfactant is present in an amount of 0.01 to 3.0 g/l.

* * * * *